US012480242B2

(12) United States Patent
Seaton

(10) Patent No.: US 12,480,242 B2
(45) Date of Patent: Nov. 25, 2025

(54) SYSTEM AND METHOD FOR CUSTOMIZED SYNTHETIC TURF DESIGN, MANUFACTURING AND INSTALLATION

(71) Applicant: Reed J. Seaton, Austin, TX (US)

(72) Inventor: Reed J. Seaton, Austin, TX (US)

( * ) Notice: Subject to any disclaimer, the term of this patent is extended or adjusted under 35 U.S.C. 154(b) by 0 days.

(21) Appl. No.: 18/783,972

(22) Filed: Jul. 25, 2024

(65) Prior Publication Data

US 2025/0034771 A1 Jan. 30, 2025

Related U.S. Application Data

(60) Provisional application No. 63/528,804, filed on Jul. 25, 2023.

(51) Int. Cl.

| | |
|---|---|
| ***D05C 13/02*** | (2006.01) |
| ***D05C 15/26*** | (2006.01) |
| *E01C 13/08* | (2006.01) |

(52) U.S. Cl.

CPC ..... *D05C 13/02* (2013.01); *D05C 15/26* (2013.01); *D05D 2207/04* (2013.01); *D05D 2305/08* (2013.01); *D05D 2305/50* (2013.01); *E01C 13/08* (2013.01)

(58) Field of Classification Search

CPC ..... D05C 13/02; D05C 15/26; D05C 15/36; D05C 15/34; D05D 2305/08; D05D 2305/36; D05D 2305/50; D10B 2505/202; D06H 1/04; D06H 1/043; D06H 1/046

See application file for complete search history.

(56) References Cited

U.S. PATENT DOCUMENTS

| | | | | |
|---|---|---|---|---|
| 3,688,804 | A * | 9/1972 | Brown | D06H 1/00 139/1 R |
| 4,337,283 | A | 6/1982 | Haas, Jr. | |
| 4,849,270 | A * | 7/1989 | Evans | E06B 7/22 428/95 |
| 5,484,639 | A * | 1/1996 | Woodall | D06N 7/0073 428/95 |
| 5,816,177 | A * | 10/1998 | Brocklehurst | D06H 7/025 112/470.07 |
| 5,850,708 | A | 12/1998 | Bergevin | |
| 5,979,344 | A * | 11/1999 | Christman, Jr. | D05C 15/28 112/80.23 |
| 5,989,368 | A * | 11/1999 | Tillander | B65H 23/0216 156/379 |
| 6,048,282 | A | 4/2000 | Prévost et al. | |
| 6,295,756 | B1 | 10/2001 | Bergevin | |
| 6,723,412 | B2 | 4/2004 | Prévost | |
| 6,776,109 | B2 * | 8/2004 | Segars | D06H 3/12 112/80.23 |

(Continued)

FOREIGN PATENT DOCUMENTS

| | | | | |
|---|---|---|---|---|
| EP | 1674605 | A1 * | 6/2006 | D05C 15/16 |

*Primary Examiner* — Danny Worrell

(74) *Attorney, Agent, or Firm* — Jackson Walker LLP; Christopher J. Rourk

(57) ABSTRACT

A system for manufacturing synthetic turf is disclosed that includes an indexing system configured to affix an indexing device to a backing material, a tufting machine configured to receive the backing material and yarn and to fabricate the synthetic turf by tufting the yarn in the backing material and a controller configured to read the indexing device and to post-process the synthetic turf as a function of the indexing device.

20 Claims, 4 Drawing Sheets

(56) References Cited

U.S. PATENT DOCUMENTS

| | | | | |
|---|---|---|---|---|
| 6,877,449 | B2 * | 4/2005 | Morgante | D05C 17/02 112/80.23 |
| 7,758,281 | B2 | 7/2010 | Knox | |
| 8,329,265 | B2 | 12/2012 | Cook | |
| 9,458,579 | B2 | 10/2016 | Ishimaru | |
| 11,097,462 | B2 * | 8/2021 | McGraw | A47C 31/02 |
| 11,840,809 | B2 | 12/2023 | Lee et al. | |
| 2002/0108550 | A1 * | 8/2002 | Segars | D06H 3/125 112/80.32 |
| 2005/0188905 | A1 * | 9/2005 | Dabrowa | D05C 15/34 112/102.5 |
| 2008/0017060 | A1 * | 1/2008 | Seidler | B65H 43/04 101/483 |
| 2011/0020567 | A1 | 1/2011 | Avery | |
| 2013/0180440 | A1 * | 7/2013 | Hall | D05C 15/16 112/80.32 |
| 2014/0000497 | A1 * | 1/2014 | Modra | D05C 15/12 112/80.32 |
| 2014/0305358 | A1 * | 10/2014 | Heeres | D05B 19/12 112/475.08 |
| 2020/0283285 | A1 * | 9/2020 | Rodgers | B68G 7/08 |
| 2023/0183899 | A1 * | 6/2023 | Pongrass | D05C 15/14 112/410 |
| 2024/0240395 | A1 * | 7/2024 | MacMeccan | D05C 17/026 |
| 2024/0240397 | A1 * | 7/2024 | MacMeccan | D05C 17/026 |
| 2024/0240398 | A1 * | 7/2024 | MacMeccan | D05C 17/026 |

* cited by examiner

200

300

400

500

SYSTEM AND METHOD FOR CUSTOMIZED SYNTHETIC TURF DESIGN, MANUFACTURING AND INSTALLATION

RELATED APPLICATIONS

The present application claims priority to and benefit of U.S. Provisional Patent application 63/528,804, filed Jul. 25, 2023, which is hereby incorporated by reference for all purposes as if set forth herein in its entirety.

TECHNICAL FIELD

The present disclosure relates generally to synthetic turf, and more specifically to a system and method for customized synthetic turf design, manufacturing and installation.

BACKGROUND OF THE INVENTION

Synthetic turf is usually customized on site, which is labor intensive and which also generates a substantial volume of waste.

SUMMARY OF THE INVENTION

A system for manufacturing synthetic turf is disclosed that includes an indexing system configured to affix an indexing device to a backing material, such as nylon, polypropylene or polyethylene. A tufting machine receives the backing material and yarn and fabricates the synthetic turf by tufting the yarn in the backing material. A controller reads the indexing device and post-processes the synthetic turf as a function of the indexing device, such as by cutting out the yarn in predetermined locations to form a design and then by tufting yarn of a different color in the predetermined locations.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1:
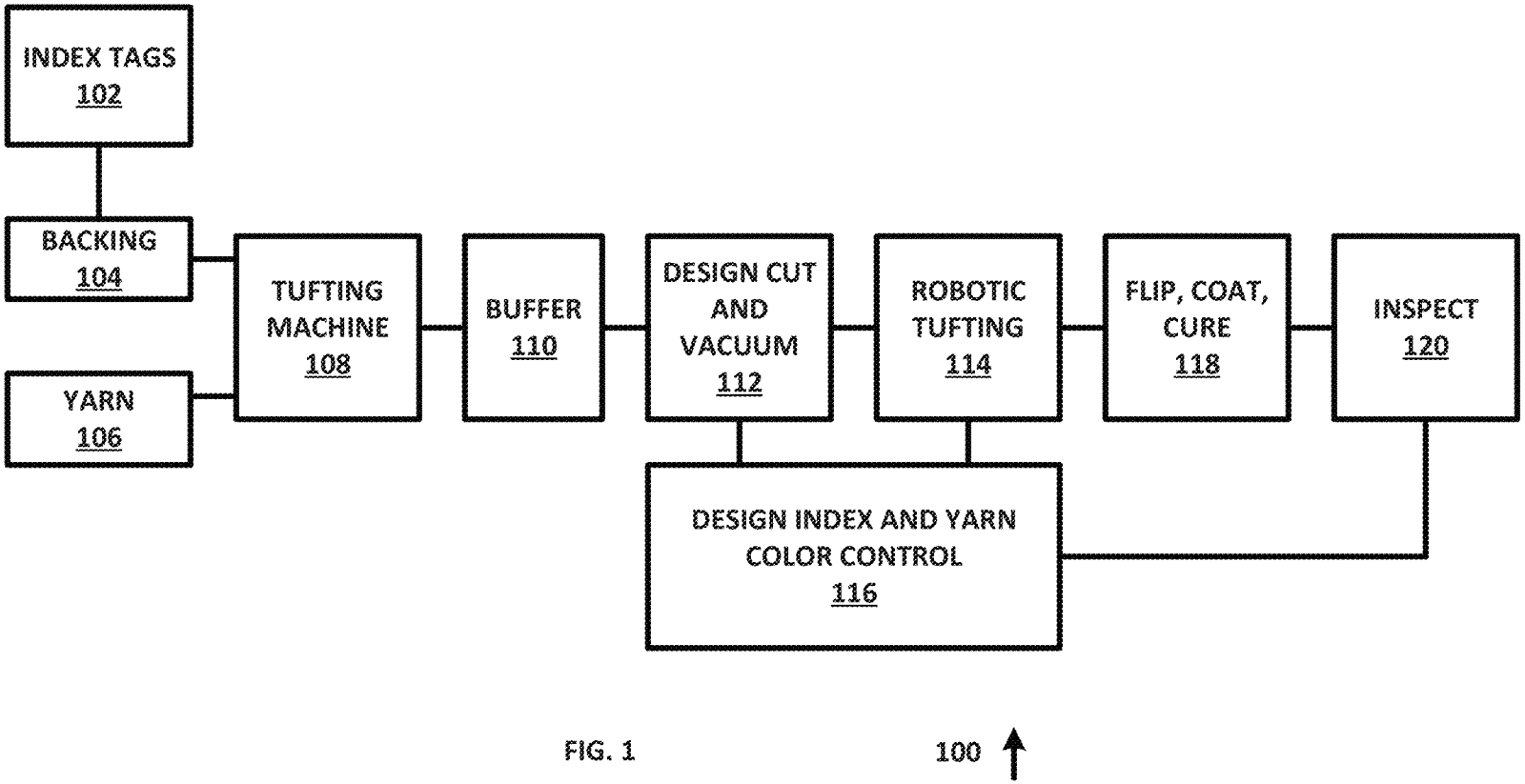
FIG. 1 is a diagram of a system for synthetic turf customization, in accordance with an example embodiment of the present disclosure.

In the description that follows, like parts are marked throughout the specification and drawings with the same reference numerals. The drawing figures may be to scale and certain components can be shown in generalized or schematic form and identified by commercial designations in the interest of clarity and conciseness.

Synthetic turf is manufactured by tufting yarn in a backing material. The yarn is a single color, and in order to customize the turf to add field markings and team logos, it is necessary to cut holes in the fabricated synthetic turf after it has been installed and to affix synthetic turf of different colors in the holes. This process is labor-intensive and time consuming, and often results in a less durable product that requires repair after it has been exposed to weather and use. This process also results in a significant amount of waste, as the material that is used to create the customized synthetic turf must be discarded because it has been cut to fit the holes that were made. The present disclosure provides a system and method for fabricating customized synthetic fabric that eliminates the need for expensive, wasteful and time consuming existing processes and allows customized synthetic turf to be manufactured just in time for it to be installed, which eliminates additional costs associated with fabricating and storing synthetic turf having different colors.

FIG. 1 is a diagram of a system 100 for synthetic turf customization, in accordance with an example embodiment of the present disclosure. System 100 includes index tag system 102, backing system 104, yarn system 106, tufting machine 108, buffer 110, design cut and vacuum system 112, robotic tufting system 114, design index and yarn color control system 116, flip, coat and cure system 118 and inspection system 120, each of which can be implemented in hardware, or a suitable combination of hardware and software.

Index tag system 102 generates an index associated with the placement of tags on backing and stores index tag location data that is cross-referenced to a physical location on the backing. In one example embodiment, index tag system 102 can be used to correlate the location of an index tag to a physical location along the edge of a roll of backing for synthetic turf or other suitable materials. In this example embodiment, the index tags can be metal tags, radio frequency identification tags or other suitable machine readable tags that can be located within a predetermined accuracy along the edge of backing material by a machine vision device (such as an optical scanner, a radio frequency scanner, or other suitable machine vision devices), such as one one-thousandth of an inch, to allow a location of the backing material to be precisely determined.

Backing system 104 provides synthetic backing material to tufting machine 108, and can include one or more hydraulic rollers, electromechanical rollers or other suitable devices that can receive a roll of synthetic backing material on which tufts of yarn or other suitable materials will be installed. The backing material can be a nonwoven textile manufactured from polypropylene, can include a secondary layer manufactured from latex or polyurethane, or can be manufactured in other suitable manners from other suitable materials. In one example embodiment, backing system 104 can include rolls of backing that are fed to tufting machine 108, where the backing is cut or sewn together, depending on the length of backing required.

Yarn system 106 provides synthetic yarn to tufting machine 108. In one example embodiment, the yarn can be manufactured from nylon, polypropylene, polyethylene, other suitable materials or a suitable combination of materials. Yarn system 106 can provide a suitable background yarn color, such as green or brown depending on the application. The yarn can be fed as part of a continuous tufting process or in other suitable manners.

Tufting machine 108 receives backing and yarn and generates synthetic turf by threading the yarn through the backing at predetermined intervals and then cutting the yarn so that it forms an synthetic turf. In one example embodiment, tufting machine 108 can also buffer the manufactured synthetic turf by reducing the manufacturing speed, by using one or more buffering systems or in other suitable manners. The synthetic turf is then provided to buffer 110.

Buffer 110 receives the synthetic turf from tufting machine 108 and provides a buffering function. In one example embodiment, buffer 110 can include a number of rolls that run at different speeds and with different configurations, to increase an effective distance that the synthetic turf travels, consistent with the speed of downstream manufacturing systems such as design cut and vacuum system 112. Buffer 110 provides the synthetic turf to design cut and vacuum system 112. Additional buffers can be provided as needed as part of or after other stages, such as part of or after design cut and vacuum system 112 and robotic tufting system 114.

Design cut and vacuum system 112 receives design data from design index and yarn color control system 116 and identifies a location for a design cut using index tag data. In one example embodiment, design cut and vacuum system 112 can read an index tag to identify a location along an edge of a roll of synthetic turf and can identify an associated design that should be cut from the synthetic turf. In this example embodiment, design cut and vacuum system 112 can include one or more cutting heads that cut the yarn at a predetermined distance from the backing material in a predetermined pattern, and one or more vacuum devices that vacuum the cut yarn to remove it from the synthetic turf. The vacuumed cut yarn can then be transported to a storage bin for recycling or used for other suitable purposes, and the modified synthetic turf can be provided to robotic tufting system 114.

Robotic tufting system 114 receives the modified synthetic turf from design cut and vacuum system 112, design data from design index and yarn color control system 116 and index data from index tags and determines a proper color of yarn for the installation of tufting at a predetermined location. In one example embodiment, the design data received from design index and yarn color control system 116 can identify numbers, field markings, team logos or other suitable designs that should be cut from the background color of the synthetic turf and then installed using yarn that has a different color. In this example embodiment, robotic tufting system 114 can include one or more tufting devices, where each tufting device provides a different color of yarn. Robotic tufting system 114 can also include one or more machine vision devices to help guide the location of the tufting devices, such as to ensure correspondence with the design that has been cut by design cut and vacuum system 112, or for other suitable purposes. Robotic tufting system 114 then provides the synthetic turf with the customized design to flip, coat and cure system 118.

Flip, coat and cure system 118 receives synthetic turf from robotic tufting system 114 and turns the finished synthetic turf product upside down for coating with a sealant, such as a polyester, nylon, polypropylene, polyethylene or other suitable powder with a low melting point. The sealant can then be cured in an oven or in other suitable manners, such as to cross-link the powder to form a seal. The sealed synthetic turf is then provided to inspection system 120.

Inspection system 120 receives design data from design index and yarn color control system 116 and index data and inspects the finished synthetic turf to ensure that the installation of colored yarn and the location of the design is in accordance with the predetermined design data. In one example embodiment, inspection system 120 can read index tag data from the backing and can use machine vision, artificial intelligence and other suitable processes to determine whether the intended design has been properly installed. If inspection system 120 determines that the predetermined design has not been properly installed, an error signal can be generated to facilitate operator intervention to correct the problem and to prevent the synthetic turf from being shipped for installation.

In operation, system 100 is used to manufacture customized synthetic turf for installation on a field without the need for subsequent labor, time and materials to further customize the synthetic turf. In one example embodiment, system 100 can eliminate the need for customization of synthetic turf on site, which typically requires cutting out a design from the synthetic turf and installing colored synthetic turf in the cutout. The synthetic turf must then be re-sealed, and other common practices that are time intensive and labor-intensive must be implemented to ensure that the design has been properly installed. System 100 thus eliminates the need for on-site customization and facilitates just in time manufacture and installation of customized synthetic turf for specific installations.

Figure 2:
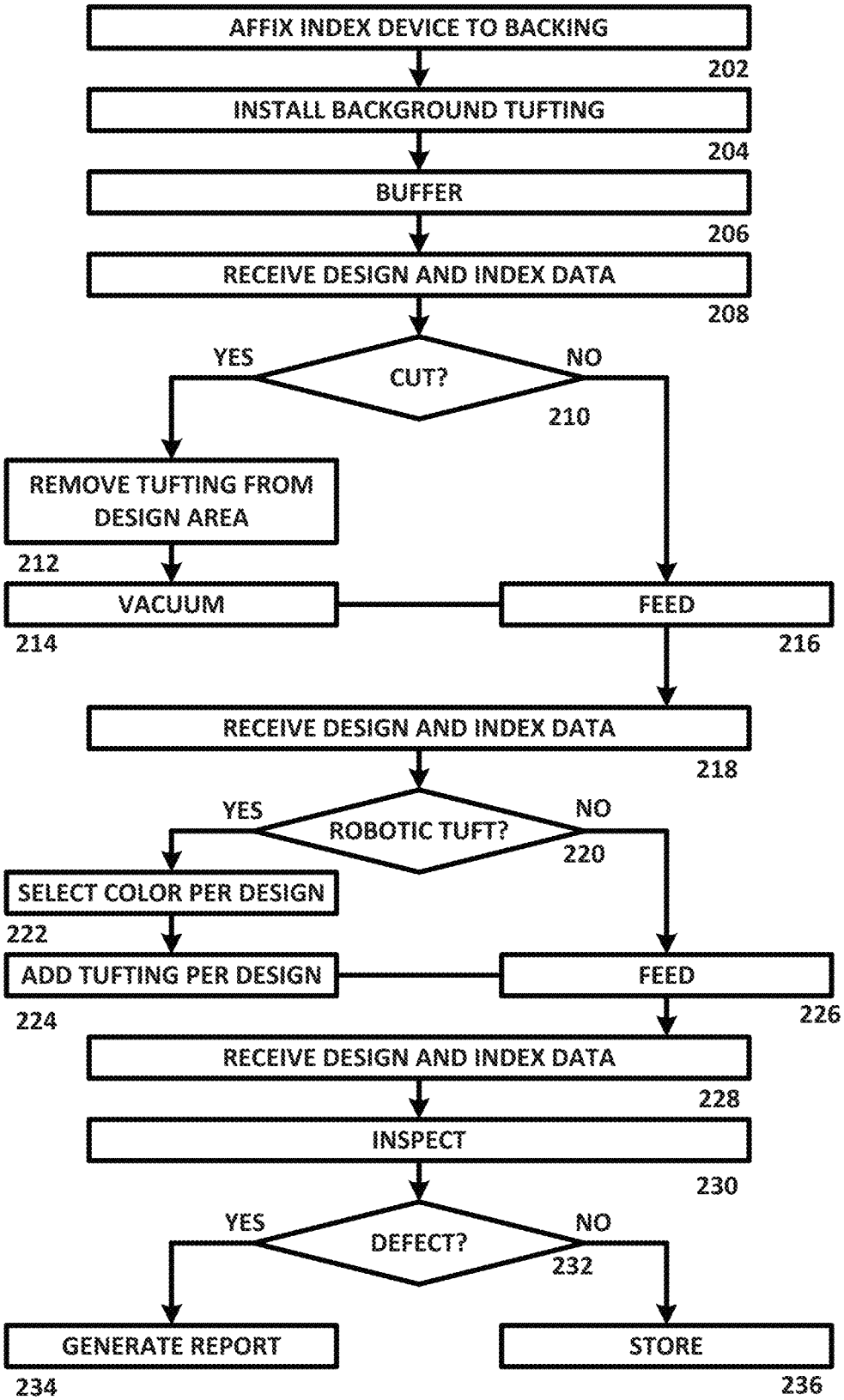
FIG. 2 is a diagram of an algorithm for manufacturing customized synthetic turf, in accordance with an example embodiment of the present disclosure.

FIG. 2 is a diagram of an algorithm 200 for manufacturing customized synthetic turf, in accordance with an example embodiment of the present disclosure. Algorithm 200 can be implemented in hardware or a suitable combination of hardware and software.

Algorithm 200 begins at 202, where an index device is affixed to a backing material. In one example embodiment, the location of the index device on the backing material can be generated relative to a leading edge of the backing material or in other suitable manners. The tolerance for the placement of the index device can also be indicated or other suitable data can also or alternatively be generated. The algorithm then proceeds to 204.

At 204, background tufting is installed on the backing material. In one example embodiment, a tufting machine can be used that installs yarn tufts at predetermined locations, such as by punching a hole through the backing material, installing a yarn loop and cutting the loop to create the tuft. Likewise, other suitable processes can also or alternatively be used. The algorithm then proceeds to 206.

At 206, the tufted synthetic turf is buffered. In one example embodiment, buffering can be adjusted to accommodate subsequent process stages, such as to speed up transfer of the synthetic turf when no additional work is needed and to slow down transfer of the synthetic turf when a customized design is being cut into the synthetic turf. Buffering can also or alternatively be provided between other stages or as part of the processing performed by a stage, as discussed further herein. The algorithm then proceeds to 208.

At 208, design and index data is received at a cutting and vacuum system, such as from a design and index data system, from one or more index device readers or in other suitable manners. The algorithm then proceeds to 210.

At 210, it is determined whether cutting is required at a location as a function of the design and index data. In one example embodiment, the dimensions of the cutting device and other physical parameters can be used to determine where to stop the synthetic turf and backing material for cutting. If it is determined that cutting is not required at 210, the algorithm proceeds to 216, otherwise the algorithm proceeds to 212.

At 212, tufting is removed from a design area. In one example embodiment, one or more cutting heads can cut tufted yarn at a predetermined distance from a backing material that the tufted yarn is attached to, or other suitable processes can also or alternatively be used. The algorithm then proceeds to 214.

At 214, the yarn that has been cut from the backing is vacuumed. In one example embodiment, the vacuumed cut yarn can be accumulated and recycled for other uses. The algorithm then proceeds to 216.

At 216, the synthetic turf and backing material is fed a predetermined distance, such as to continue generation of a design, or to feed the synthetic turf to a new stage, such as a robotic tufting stage. The algorithm then proceeds 218.

At 218, index tag data and design and index data is received at a robotic tufting system or other suitable systems. In one example embodiment, the index tag data can be read using one or more tag readers to identify a location along an edge of the synthetic turf or other suitable processes can also or alternatively be used. The algorithm then proceeds to 220.

At 220, it is determined whether robotic tufting is required. If it is determined that robotic tufting is not required, the algorithm proceeds to 226, otherwise the algorithm proceeds to 222.

At 222 a color for robotic tufting is selected in accordance with the design data. In one example embodiment, the color can be associated with field markings such as numbers, yard markers, or other suitable designs. In another example embodiment, the color can be associated with a team logo or other suitable designs. The algorithm then proceeds to 224.

At 224, tufting is installed using one or more robotic tufting devices, in accordance with the design data. In one example embodiment, machine vision devices can be used to determine the placement of the tufting machine head, to align the tufting machine head with index tag data, to select a machine head with a specific color yarn or for other suitable purposes. The algorithm then proceeds to 226.

At 226, the tufted synthetic turf is inverted and a sealant is applied, such as by applying a polyester, nylon, polypropylene, polyethylene or other suitable powder that is subsequently cured or cross-linked, or in other suitable manners. The sealed synthetic turf is then fed to an inspection system. The algorithm then proceeds to 228.

At 228, design and index data is received at an inspection system. The algorithm then proceeds to 230.

At 230, the customized synthetic turf is inspected. In one example embodiment, one or more machine vision devices can be used to inspect the location of the design to ensure that it is in accordance with predetermined design data. The algorithm then proceeds to 232.

At 232, it is determined whether a defect has been identified. If no defect has been identified, the algorithm proceeds to 236 where the finished synthetic turf product is stored for shipment. Otherwise, the algorithm proceeds to 234 where a report of the presence of a defect is generated to alert an operator of the defect.

In operation, algorithm 200 allows customized, synthetic turf to be manufactured for delivery to a predetermined location. Algorithm 200 facilitates just in time manufacture of synthetic turf with customize designs to eliminate the need for customization on site, to eliminate defects that can result from customization on site, and other noted problems. While algorithm 200 is shown as a flow chart, a person of skill in the art will recognize that it can also or alternatively be implemented using object oriented programming, state diagrams, ladder diagrams or in other suitable manners.

Figure 3:
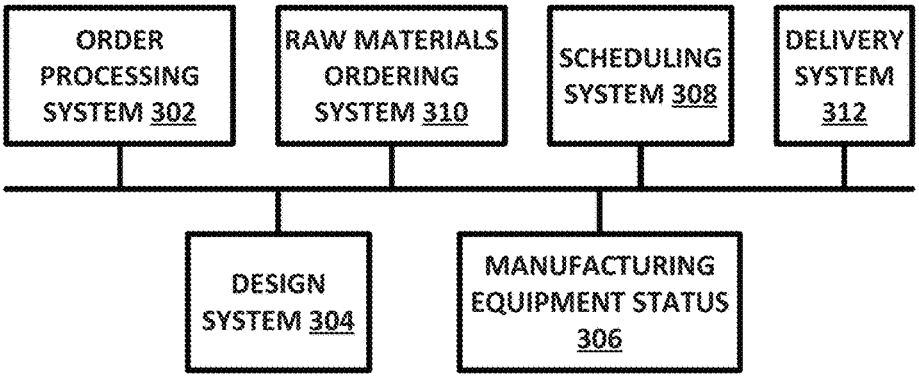
FIG. 3 is a diagram of a system for just in time manufacturing of customized synthetic turf, in accordance with an example embodiment of the present disclosure.

FIG. 3 is a diagram of a system 300 for just in time manufacturing of customized synthetic turf, in accordance with an example embodiment of the present disclosure. System 300 includes order processing system 302, design system 304, manufacturing equipment status system 306, scheduling system 308, raw materials ordering system 310 and delivery system 312, each of which can be implemented in hardware or suitable combination of hardware and software.

Order processing system 302 is configured to generate one or more user interface controls to allow a user to enter an order for a customized synthetic turf design. In one example embodiment, a user can receive information regarding costs, lead times, design charges, and other suitable data, and can generate an order using the provided data. In another example embodiment, the user can interface with one or more other systems of system 300 during the order process, to facilitate order processing.

Design system 304 allows a user to generate a design for customized synthetic turf. In one example environment, design system 304 can include one or more design templates, such as a football field template, a baseball field template, or other suitable templates. The user can upload and place artwork for a team logo within the template, can change sizes and locations of field markings and can make other suitable modifications to the template, which can then be saved as a unique order. Design system 304 can interoperate with order processing system 302 to generate an updated cost estimate for the modified design and can perform other suitable functions.

Manufacturing equipment status system 306 stores manufacturing equipment status data to facilitate order estimates for just in time manufacturing. In one example embodiment, future orders with delivery dates can be used to schedule maintenance for manufacturing equipment, status data for manufacturing equipment that is out of service can be updated to track expected repair times, and other suitable data can be used to ensure that manufacturing activities do not impact just in time delivery of customized synthetic turf.

Scheduling system 308 receives order data from order processing system 302 and generates a schedule. In one example embodiment, scheduling system 308 can be used to minimize the amount of time that a completed customized synthetic turf product must be stored, such as by changing the sequence in which orders are processed. In this example embodiment, a customer can have a delivery window of several months, which can be used to flexibly schedule manufacturing and delivery times for different jobs.

Raw materials ordering system 310 interacts with order processing system 302 and design system 304 to generate material orders for all materials. In one sample, embodiment, raw materials, can include background yarn, backing materials, colored yarn and other suitable materials, where raw materials ordering system 310 can be used to reduce the amount of materials that are stored prior to being needed.

Delivery system 312 is used to schedule delivery of completed customized synthetic turf. In one example embodiment, delivery system 312 can be used to schedule rolling storage, such as to use existing trucking facilities as storage, and to temporarily store completed product in trucking facilities.

In operation, system 300 allows customized synthetic turf products to be manufactured just in time, so as to reduce storage requirements and to ensure timely delivery. System 300 allows customers to interface with the order processing and design to ensure that customer objectives are satisfied.

Figure 4:
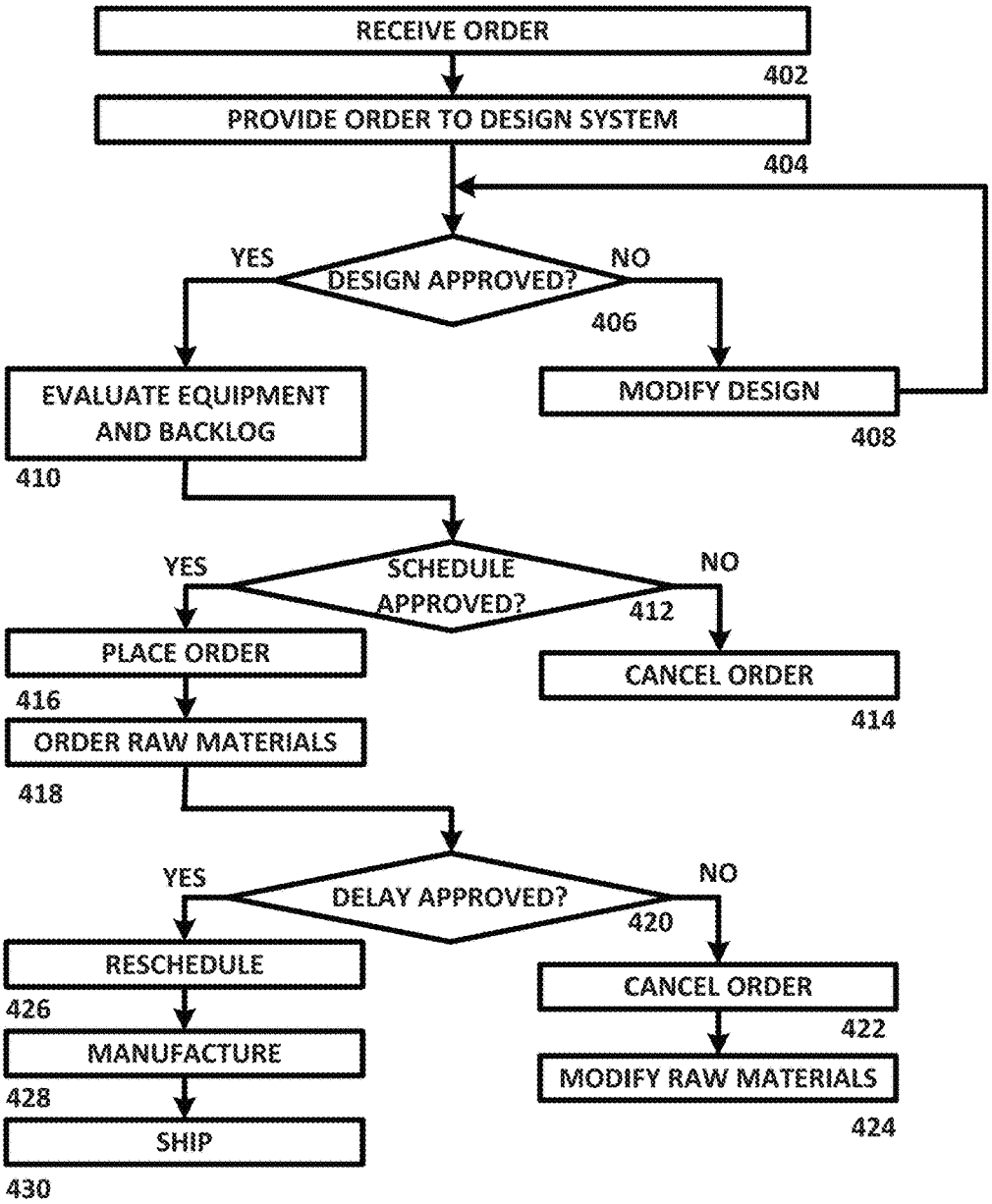
FIG. 4 is a diagram of an algorithm for just in time processing of customized synthetic turf, in accordance with an example embodiment of the present disclosure.

FIG. 4 is a diagram of an algorithm 400 for just in time processing of customized synthetic turf, in accordance with an example embodiment of the present disclosure. Algorithm 400 could be implemented in hardware or a suitable combination of hardware and software.

Algorithm 400 begins at 402, where an order is received. In one example embodiment, the order can be received from a web browser user interface with a plurality of controls that allow a user to enter an order without assistance from sales personnel or in other suitable manners. The algorithm then proceeds to 404.

At 404, the order is provided to a design system. In one example embodiment, the order can be made in conjunction with a design system, such as by using one more templates, where a user is allowed to upload customized artwork, change fonts or placement of marks and numbers, or in other suitable manners. The algorithm then proceeds to 406.

At 406, it is determined whether a design has been approved. In one example embodiment, a user can generate an order and can enter an associated design without oversight, and a final check of design sufficiency can be performed by specialists or other suitable processes can be used. If it is determined at 406 that the design is not approved, the algorithm proceeds to 408 and the design can be modified, such as to propose an acceptable design, or to request clarification. The algorithm then returns to 406. Otherwise, if the designer is approved at 406, the algorithm proceeds to 410.

At 410, equipment status and backlog is evaluated. In one example embodiment, the scheduled downtime for equipment, damage to equipment, backlog orders, or other suitable data can be used to determine whether an order can be delivered at a required time. The algorithm then proceeds to 412.

At 412, it is determined whether a schedule has been approved. In one example embodiment, a customer may have a deadline by which the customized synthetic turf product is required, which may not be possible to meet. If the schedule is not approved, the algorithm proceeds to 414 and the order is canceled. Otherwise it algorithm proceeds to 416.

At 416, the order is placed. In one example embodiment, placing the order can include updating one or more schedules for manufacturing, delivery or other suitable data. The algorithm then proceeds to 418.

At 418, raw materials are ordered. In one example embodiment, raw materials can be periodically ordered, the amount of raw materials can be increased or decreased as a function of orders placed or other suitable processes can also or alternatively used. The algorithm then proceeds to 420.

At 420, it is determined whether a delay has been incurred and approved. If a delay has been occurred and is not approved, the algorithm proceeds to 422 and the order is canceled. The algorithm then proceeds to 424 where raw materials are modified to reflect the canceled order.

If a delay is not necessary or has been approved, the algorithm proceeds to 426 where delivery can be rescheduled if needed. The algorithm then proceeds to 428 were the customized synthetic turf product is manufactured. The algorithm then proceeds to 430 where the finished product shipped to be delivered just in time for insulation.

Figure 5:
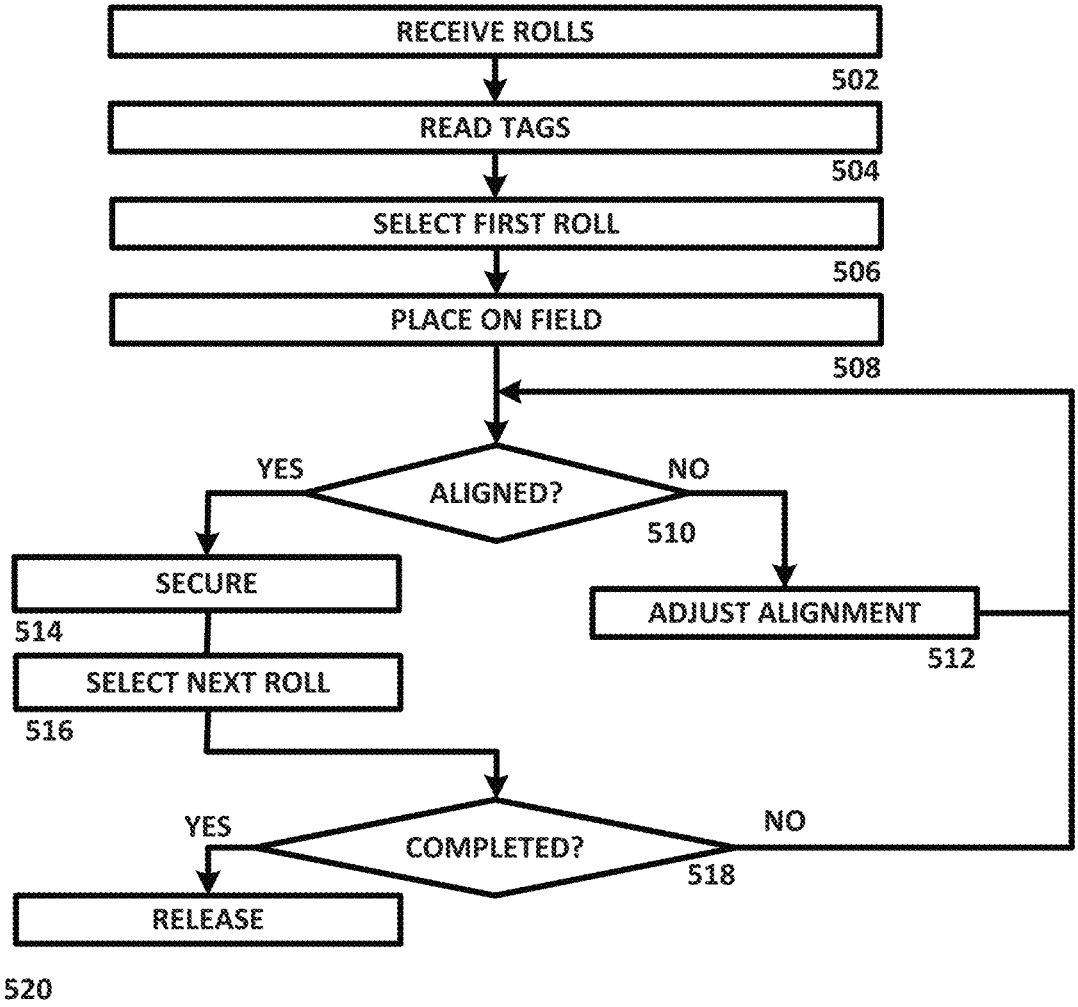
FIG. 5 is a diagram of algorithm for installing customized synthetic turf, in accordance with an example embodiment of the present disclosure.

FIG. 5 is a diagram of algorithm 500 for installing customized synthetic turf, in accordance with an example embodiment of the present disclosure. Algorithm 500 can be implemented in hardware or a suitable combination of hardware and software.

Algorithm 500 begins at 502, where a plurality of rolls of customized synthetic turf are received. In one example, embodiment, the rolls can be received just in time for installation, so as to eliminate the need for storage of rolls prior to installation. The algorithm then proceeds to 504.

At 504, tags are read on the ends of the rolls. In one example embodiment, the rolls can each have a plurality of tags that identify a location associated with the roll, such as a field location. The location of each roll relative to a position on the field can be identified and used to sequence installation. The algorithm then proceeds to 506.

At 506, a first roll is selected for installation. In one example embodiment, installation of the customized synthetic turf can be sequenced from one end of a field to the other, can start in the middle of a field, or other suitable processes can also or alternatively be use. The algorithm then proceeds to 508.

At 508, the roll is placed on the field. In one example embodiment, the roll can be secured in position or other suitable processes can also or alternatively be used. The algorithm then proceeds to 510.

At 510, it is determined whether the roll has been properly aligned. In one example embodiment, the alignment of one or more tags can be validated in reference to the location of the field. If it is determined that the roll is not aligned, the algorithm proceeds to 512 where the alignment is adjusted. In one example embodiment, the indexing of the tags can be modified, the placement of the roll can be modified, or other suitable processes can also or alternatively be used. The algorithm then returns to 510. If alignment is proper, the algorithm returns to 514.

At 514, the customized synthetic turf is secured to the field. The algorithm than proceeds to 516, where the next roll is selected and the algorithm proceeds to 518.

At 518, it is determined whether the last roll has been installed. If the last roll has not been installed, the algorithm returns to 510. If the last roll has been installed and the process is complete, the algorithm proceeds to 520 and the installation is released.

In operation, algorithm 500 allows customize synthetic turf to be installed and indexed to ensure proper placement. Although algorithm 500 is shown as a flow chart, a person of ordinary skill in art will recognize that algorithm 500 can also or alternatively be implemented as an object oriented diagram, a state diagram, a ladder diagram or in other suitable manners.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. A software system is typically created as an algorithmic source code by a human programmer, and the source code algorithm is then compiled into a machine language algorithm with the source code algorithm functions, and linked to the specific input/output devices, dynamic link libraries and other specific hardware and software components of a processor, which converts the processor from a general purpose processor into a specific purpose processor. This well-known process for implementing an algorithm using a processor should require no explanation for one of even rudimentary skill in the art. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. A system can receive one or more data inputs, such as data fields, user-entered data, control data in response to a user prompt or other suitable data, and can determine an action to take based on an algorithm, such as to proceed to a next algorithmic step if data is received, to repeat a prompt if data is not received, to perform a mathematical operation on two data fields, to sort or display data fields or to perform other suitable well-known algorithmic functions. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for manufacturing synthetic turf, comprising:

an indexing system configured to affix an indexing device to a backing material;

a tufting machine configured to receive the backing material and background yarn and to fabricate the synthetic turf by tufting the background yarn in the backing material;

a controller configured to read the indexing device and to post-process the synthetic turf as a function of the indexing device; and a design cut system coupled to the controller, wherein the controller generates control data to cause the design cut system to cut the background yarn from the backing material at predetermined locations.

2. The system of claim 1 wherein the indexing system attaches a machine-readable device to the backing material.

3. The system of claim 1 further comprising a design cut system coupled to the controller, wherein the controller generates control data to cause the design cut system to cut the background yarn from the backing material at predetermined locations as a function of a location of the indexing device.

4. The system of claim 1 further comprising a design cut and vacuum system coupled to the controller, wherein the controller generates control data that cause the design cut and vacuum system to cut the background yarn from the backing material at predetermined locations and to vacuum the cut yarn.

5. The system of claim 1 further comprising a robotic tufting system coupled to the controller, wherein the controller generates control data that cause the robotic tufting system to tuft colored yarn at one or more predetermined locations.

6. The system of claim 1 further comprising a robotic tufting system coupled to the controller, wherein the controller generates control data that cause the robotic tufting system to tuft colored yarn at one or more predetermined locations as a function of a location of the indexing device.

7. The system of claim 1 further comprising a robotic tufting system coupled to the controller, wherein the controller generates control data that cause the robotic tufting system to select colored yarn having one of two or more colors and to tuft the selected colored yarn at one or more predetermined locations.

8. The system of claim 1 further comprising a robotic tufting system coupled to the controller, wherein the controller generates control data that cause the robotic tufting system to select colored yarn having one of two or more colors and to tuft the selected colored yarn at one or more predetermined locations where the background yarn has been removed.

9. The system of claim 1 further comprising:

a design cut system coupled to the controller, wherein the controller generates control data to cause the design cut system to cut the background yarn from the backing material at predetermined locations as a function of a location of the indexing device; and a robotic tufting system coupled to the controller, wherein the controller generates control data that cause the robotic tufting system to select colored yarn having one of two or more colors and to tuft the selected colored yarn at one or more predetermined locations where the background yarn has been removed.

10. A method for manufacturing synthetic turf comprising:

affixing an indexing device to a backing material;

fabricating the synthetic turf by tufting background yarn in the backing material;

reading the indexing device on the synthetic turf using a machine vision device;

generating post-processing control data with a controller to post-process the synthetic turf as a function of the indexing device; and generating control data to cause a design cut system to cut the background yarn from the backing material at predetermined locations.

11. The method of claim 10 wherein the indexing device is a machine-readable device.

12. The method of claim 10 further comprising generating control data with the controller to cause a design cut system to cut the background yarn from the backing material at predetermined locations as a function of a location of the indexing device.

13. The method of claim 10 further comprising generating control data with the controller to cause a design cut and vacuum system to cut the background yarn from the backing material at predetermined locations and to vacuum the cut yarn.

14. The method of claim 10 further comprising generating control data using the controller to cause a robotic tufting system to tuft colored yarn at one or more predetermined locations.

15. The method of claim 10 further comprising generating control data to cause a robotic tufting system to tuft colored yarn at one or more predetermined locations as a function of a location of the indexing device.

16. The method of claim 10 further comprising generating control data to cause a robotic tufting system to select colored yarn having one of two or more colors and to tuft the selected colored yarn at one or more predetermined locations.

17. The method of claim 10 further comprising generating control data with the controller to cause a robotic tufting system to select colored yarn having one of two or more colors and to tuft the selected colored yarn at one or more predetermined locations where the background yarn has been removed.

18. The method of claim 10 further comprising:

generates control data with the controller to cause a design cut system to cut the background yarn from the backing material at predetermined locations as a function of a location of the indexing device; and generating control data with the controller to cause a robotic tufting system to select colored yarn having one of two or more colors and to tuft the selected colored yarn at one or more predetermined locations where the background yarn has been removed.

19. A method for manufacturing synthetic turf comprising:

affixing an indexing device to a backing material;

fabricating the synthetic turf by tufting background yarn in the backing material;

reading the indexing device on the synthetic turf using a machine vision device;

generating post-processing control data with a controller to post-process the synthetic turf as a function of the indexing device; and generating control data using the controller to cause a robotic tufting system to tuft colored yarn at one or more predetermined locations.

20. The method of claim 19 where generating the control data to cause the robotic tufting system to tuft the colored yarn at the one or more predetermined locations is performed as a function of a location of the indexing device.

* * * * *